US006921354B1

(12) United States Patent
Shifferaw

(10) Patent No.: US 6,921,354 B1
(45) Date of Patent: Jul. 26, 2005

(54) EXERCISE HARNESS AND METHOD

(76) Inventor: Tessema Dosho Shifferaw, 1019 Solano Ave., Albany, CA (US) 94706

( * ) Notice: Subject to any disclaimer, the term of this patent is extended or adjusted under 35 U.S.C. 154(b) by 542 days.

(21) Appl. No.: 10/051,882

(22) Filed: Jan. 15, 2002

(51) Int. Cl.[7] ..... A63B 69/00
(52) U.S. Cl. ..... 482/91; 482/126; 482/904
(58) Field of Search ..... 482/121, 122, 482/126, 127, 129, 904, 91, 130

(56) References Cited

U.S. PATENT DOCUMENTS 4,685,671 A * 8/1987 Hagerman et al. ..... 482/124
4,909,505 A * 3/1990 Tee ..... 482/129
5,100,129 A * 3/1992 Porter et al. ..... 482/129
5,518,486 A 5/1996 Sheeler
6,036,625 A * 3/2000 Woodruff ..... 482/121
6,059,698 A 5/2000 Mazor
6,726,606 B2 * 4/2004 Jacobsen ..... 482/121

* cited by examiner

*Primary Examiner*—Glenn E. Richman
(74) *Attorney, Agent, or Firm*—Edward S. Wright

(57) ABSTRACT

Exercise device and method in which the device comprises a pair of elongated flexible straps, with hand grips and an anchor attached to the straps. The straps are adapted to pass between a door and the jamb in which it is mounted, with the anchor and the grips on opposite sides of the door, and the anchor abutting against the door to retain the straps in position when a pull is exerted on them by an exerciser. The exerciser leans away from the door, and does an exercises while holding the grips and leaning so that the weight of his body serves as resistance for the exercises.

10 Claims, 2 Drawing Sheets

EXERCISE HARNESS AND METHOD

This invention pertains generally to exercise and fitness and, more particularly, to a harness for use in exercising and to a method of exercise with the harness.

Of the many different types of exercise equipment heretofore provided, lightweight, portable devices are of particular interest to people who desire mobility and/or an inexpensive way to exercise.

One example of such a device is found in U.S. Pat. No. 6,059,698. That device has a plurality of elastic cords which are attached to brackets that hook over the edges of a door. A person exercises by pulling the cords away from the face of the door with his arms or legs.

U.S. Pat. No. 5,518,486 discloses exercise straps which have hand grips at one end and foot loops at the other. A person exercises with these straps by grasping the grips in his hands, placing his feet in the loops, then pulling with his arms and pushing with his legs to exert opposing forces between them.

It is in general an object of the invention to provide a new and improved exercise device and method.

Another object of the invention is to provide an exercise device and method of the above character which overcome the limitations and disadvantages of the prior art.

These and other objects are achieved in accordance with the invention by providing an exercise device and method in which the device comprises a pair of elongated flexible straps, with hand grips and an anchor attached to the straps. The straps are adapted to pass between a door and the jamb in which it is mounted, with the anchor and the hand grips on opposite sides of the door, and the anchor abutting against the door and the jamb to retain the straps in position when a pull is exerted on them by an exerciser. The exerciser leans away from the door, and does exercises while holding the grips and leaning so that the weight of his body serves as resistance for the exercises.

Figure 1:
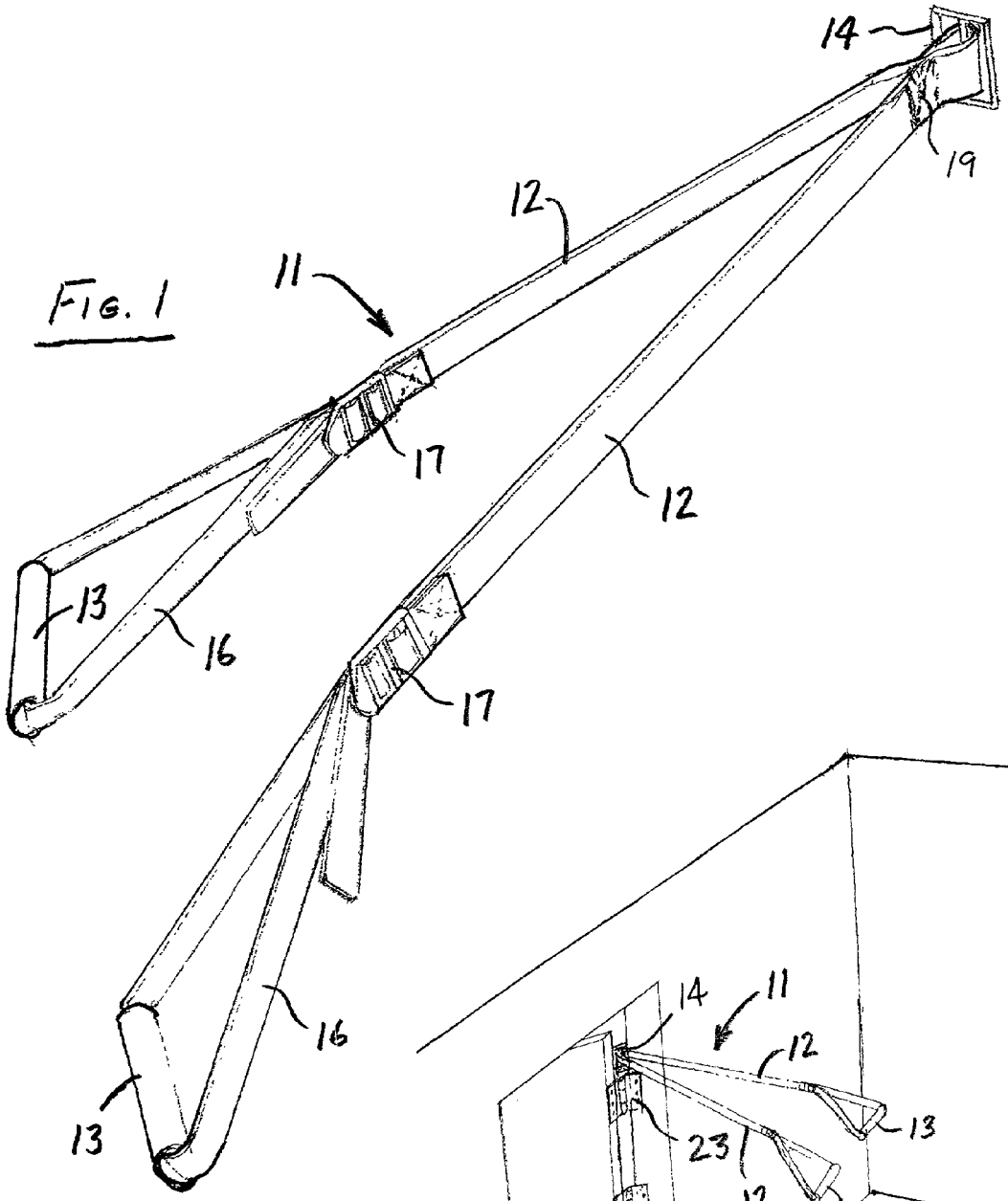
FIG. 1 is an isometric of one embodiment of an exercise harness incorporating the invention.
Figure 2:
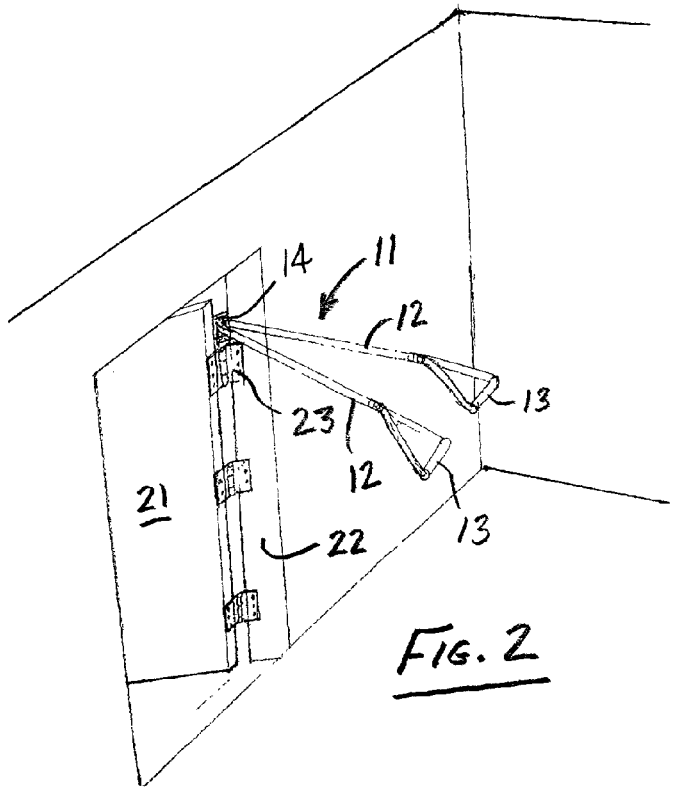
FIG. 2 is an isometric view of the embodiment of FIG. 1 attached to a door and jamb.

As illustrated in FIG. 1, the exercise device comprises a harness 11 consisting of an elongated flexible strap 12, with hand grips 13 attached to opposite ends of the strap, and an anchor 14 attached to the strap midway between the ends. Instead of a single strap with the anchor in the middle, two separate straps can be used, with either separate anchors or a common anchor affixed to one end of each strap.

The strap can be fabricated of any suitable material, most commonly one which is flexible and substantially inelastic, such as nylon, leather, or the like. However, depending upon the exercises to be performed, other materials can also be utilized, including materials which are resilient or elastic. If rods or other rigid elements are used, they are attached to the anchor in a manner which permits them to swivel or pivot, and they preferably are also telescoping or otherwise collapsible in order to make the device more compact and portable.

The hand grips are tubular or cylindrical, and in one embodiment consist of short lengths of rigid tubing which are covered with foam or other suitable padding. They are mounted on lengths of flexible material which are formed into loops 16 and attached to the ends of the strap by buckles 17. The loops can be fabricated of the same material as the strap, and the buckles permit the length of the loops, and hence the effective length of the strap, to be adjusted.

In the embodiment illustrated, anchor 14 consists of a buckle which is slipped over the central portion of the strap, midway between the hand grips, with the strap being folded back upon itself and secured by suitable means such as stitching 19.

The harness is used in connection with a door 21 by passing the portions of the strap adjacent to the anchor between the inner edge of the door and door jamb 22 above upper hinge 23. The anchor abuts against the back side of the door and the jamb, with the strap resting on the hinge and the free ends of the strap extending in front of the door and being free to swivel about the point where they emerge from the door and jamb. An exerciser grasps the grips with his hands, leans away from the door and does exercises with the weight of his body providing resistance.

Figure 3A:
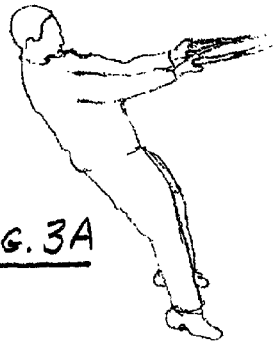
FIGS. 3A–6B are isometric views illustrating use of the embodiment of FIG. 1 in performing different exercises.
Figure 3B:
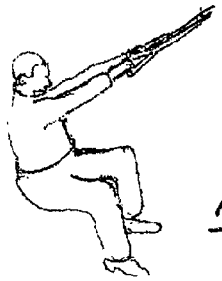

A wide variety of exercises can be done with the harness, and several examples of them are shown in the drawings. FIGS. 3A and 3B, for example, show an exerciser doing squats. In this exercise, he stands facing the door and leans back away from it, with his feet spread comfortably apart. Holding one grip in each hand, with his arms extending in front of him about chest high, he alternately bends and straightens his knees. If he also wants to exercise with his arms and/or take some of the weight off his legs, he can pull with his arms as he comes up. This exercise can be done either aerobically or anaerobically.

Figure 4A:
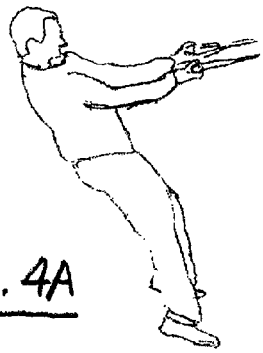
Figure 4B:
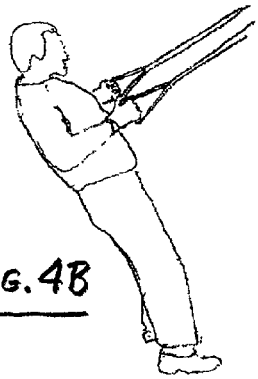

FIGS. 4A and 4B show the exerciser doing a lateral low rowing exercise from the same basic position. In this exercise, he keeps his legs straight and draws his arms down and back, bending his elbows, until his upper arms are against his sides. By bending his elbows with his upper arms against his sides, he can also do biceps curls with one or both arms. Arm and back rowing exercises can also be done from this same basic position.

Figure 5A:
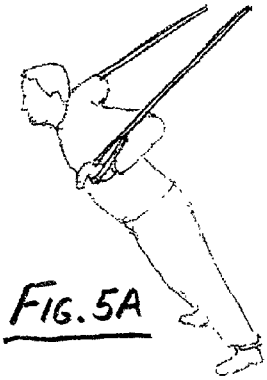
Figure 5B:
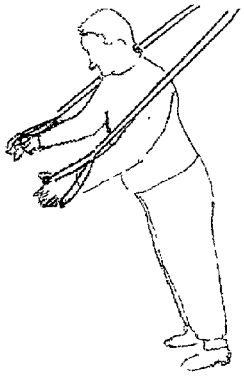

In FIGS. 5A and 5B, the exerciser is shown doing chest presses. For this exercise, he stands facing away from the door and leans forward, with his feet spread apart. He starts with his arms bent, his elbows up and back, and his hands in an overhand grip on the grips near his chest. He pushes with his arms until they are straight in front of his sides, thereby lifting himself to a more erect position against the weight of his body. He then relaxes his arms and returns to the starting position. Other exercises such as chest flies and triceps extensions can also be done from this position.

Figure 6A:
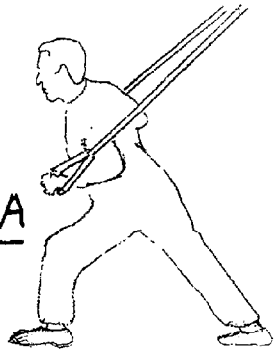
Figure 6B:
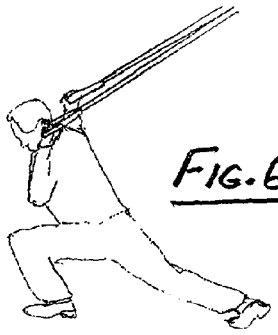

FIGS. 6A and 6B show the exerciser doing a lunge. For this exercise, he stands facing away from the door and steps forward with one foot, leaning forward and bending the forward knee as he does so. As he lunges forward and bends his knee, he also swings his arms up so that his hands rise above his shoulders. To straighten up again, he can push with either his arms or his forward leg, or both, depending on the muscles he wants to exercise and/or rest. This exercise can be done either aerobically or anaerobically.

It is apparent from the foregoing that a new and improved exercise device and method have been provided. While only ceratin presently preferred embodiments have been described in detail, as will be apparent to those familiar with the art, certain changes and modifications can be made without departing from the scope of the invention as defined by the following claims.

What is claimed is:

1. An exercise harness for use with a door, comprising a flat, flexible strap, a pair of hand grips attached to opposite ends of the flat, flexible strap, and an anchor attached to the flat, flexible strap midway between the hand grips and extending laterally from opposite sides of the strap for engagement with the door with the flat, flexible strap passing between an edge of the door and the adjacent jamb, and the anchor and the hand grips being positioned on opposite sides of the door.

2. The exercise harness of claim 1 wherein the hand grips comprise lengths of flat, flexible material which are formed into loops and attached to the ends of the strap by buckles.

3. The exercise harness of claim 1 wherein the anchor is a buckle, and the flat, flexible strap is folded back upon itself about a central portion of the buckle.

4. In combination: a door mounted in a jamb, a pair of flat, flexible exercise straps passing between an edge of the door and the jamb, hand grips attached to the flat, flexible straps on one side of the door, and an anchor attached to the straps on the side of the door opposite the hand grips and extending laterally from opposite sides of the straps in engagement with the door and the jamb for retaining the straps against the pull of an exerciser on the hand grips.

5. The combination of claim 4 wherein the straps are end portions of an elongated strap which is folded back upon itself about a portion of the anchor.

6. The combination of claim 4 wherein the hand grips comprise lengths of flat, flexible material which are formed into loops and attached to the straps by buckles.

7. The combination of claim 4 wherein the anchor is a buckle.

8. An exercise device adapted for use with a door mounted in a jamb, comprising an elongated strap which is flat and flexible, a hand grip and an anchor attached to opposite ends of the strap, the strap being adapted to pass between the door and the jamb, with the anchor and the hand grip on opposite sides of the door, and the anchor extending laterally from opposite sides of the flat strap and abutting against the door and the jamb to retain the strap in position when a pull is exerted on the strap by an exerciser.

9. The exercise device of claim 8 wherein the hand grip comprises a length of flat, flexible material which is formed into a loop and attached to the end of the strap by a buckle.

10. A method of exercise, comprising the steps of: passing a pair of flat, flexible straps between an edge of a door and a jamb, retaining the straps in place with an anchor which projects laterally from opposite sides of the straps on one side of the door for abutting engagement with the door and the jamb, grasping hand grips attached to free ends of the straps on the side of the door opposite the anchor, leaning away from the door, and doing an exercise while holding onto the hand grips and leaning away from the door so that body weight serves as resistance for the exercise.

* * * * *